US005451040A

United States Patent [19]

Crabtree

[11] Patent Number: 5,451,040

[45] Date of Patent: Sep. 19, 1995

[54] SIGNATURE FEEDER FOR A BINDING LINE

[75] Inventor: Roger L. Crabtree, Cave City, Ky.

[73] Assignee: R.R. Donnelley & Sons Co., Chicago, Ill.

[21] Appl. No.: 56,179

[22] Filed: May 3, 1993

[51] Int. Cl.[6] ..... B65H 5/00

[52] U.S. Cl. ..... 271/10.11; 271/200; 271/185; 271/186; 271/225; 271/272; 271/275; 270/54

[58] Field of Search ..... 271/10, 69, 198, 200, 271/184, 185, 186, 225, 264, 272, 275; 270/54, 55

[56] References Cited

U.S. PATENT DOCUMENTS

| | | | |
|---|---|---|---|
| 3,622,151 | 11/1971 | Range et al. | 271/74 |
| 3,838,771 | 10/1974 | Whiteford | 198/238 |
| 4,032,134 | 6/1977 | Dalmau | 281/5 |
| 4,344,727 | 8/1982 | Chaloupka | 414/36 |
| 4,844,442 | 7/1989 | Gämmerler | 271/225 |
| 4,896,874 | 1/1990 | Müller | 271/186 |
| 5,114,129 | 5/1992 | Chang et al. | 270/1.1 |
| 5,238,239 | 8/1993 | LaChapelle | 271/275 |

FOREIGN PATENT DOCUMENTS

| | | | |
|---|---|---|---|
| 1289491 | 2/1969 | Germany | 271/185 |

*Primary Examiner*—H. Grant Skaggs

*Assistant Examiner*—Carol L. Drizbick

*Attorney, Agent, or Firm*—Marshall, O'Toole, Gerstein, Murray & Borun

[57] ABSTRACT

In order to avoid ergonomic problems such as carpel tunnel syndrome while improving productivity, an apparatus for feeding signatures to a patent bound binding line is disclosed. The apparatus includes a pocket adjacent a binding line for receiving signatures to be delivered to the binding line. It also includes a signature feeder for feeding signatures from a source in a generally vertical direction to a signature receiving and transferring mechanism. The signature receiving and transferring mechanism has a signature receiving end positioned in generally vertically spaced relation to the source and a signature transferring end positioned generally adjacent to the pocket. The signature receiving and transferring mechanism has a signature conveyor for conveying signatures in a continuous stream from the signature receiving end to the signature transferring end for delivery into the pocket. There also is provided a signature invertor for inverting the signatures from a first up position to a first down position as the signatures are being conveyed to the pocket. Advantageously, the signature invertor includes a double belt having a twist which is carried on sets of rollers each at an angle to the next in order to invert the signatures during travel from the signature feeder to the pocket.

25 Claims, 4 Drawing Sheets

SIGNATURE FEEDER FOR A BINDING LINE

FIELD OF THE INVENTION

The present invention is generally directed to a signature feeder and, more particularly, an apparatus for feeding signatures to a binding line.

BACKGROUND OF THE INVENTION

In recent years, many large circulation periodicals have appeared which require rapid handling of portions of the periodicals consisting of signatures which are gathered for binding, trimmed, bundled for minimum shipping costs, and shipped. A typical operation utilizes a multitude of inserter pockets, each of which receives signatures seriatim from a signature supply means and causes the signatures to be positioned on a binding line, whether of the saddlewire type or a patent bound line, which runs in front of the inserter pockets and carries the complete collection of gathered signatures to a location for further processing to complete the binding process. Moreover, because of the need for highly efficient plant operations, there has been a constant effort to increase the speed at which machines operate which has required the development of new techniques for handling the signatures at all stages of the binding process.

In addition to high speed operation, it will be appreciated that any apparatus necessarily has to be compatible with the limit on the space that is available in a binding line facility. In development of the present invention, it was established as a goal for the signature feeding apparatus to address the concerns in terms of ergonomic problems such as carpel tunnel syndrome and the like. This was successfully addressed in commonly owned U.S. Pat. No. 5,114,129 of Chang et al. which issued on May 19, 1992 for: "Signature Feeding Apparatus" and which was directed to saddlewire binding lines. In the case of the present invention, it was recognized as important to also be able to rotate a signature stream from a first up position to a first down position while hopefully at the same time increasing capacity for stacked signatures within the same or a similar amount of floor space as conventional inserter pockets in a manner accommodating signatures in a variety of different widths. Still additionally, it was also important for any such apparatus was to be capable of operation at high speed so as to fully satisfy the demand for such a device for patent bound binding lines.

The present invention is thus directed to overcoming the foregoing problems and achieving the resulting objects as established by the development of the unique signature feeding apparatus described herein.

SUMMARY OF THE INVENTION

It is a principal object of the present invention to provide an improved apparatus for feeding signatures to a binding line. It is a further object of the present invention to provide a signature feeding apparatus which is configured to feed signatures in a shingled stream for a patent bound line wherein the apparatus accepts a high capacity of stacked signatures in a minimum amount of floor space and operates at high speed to increase productivity. It is an additional object of the present invention to provide a signature feeding apparatus sensitive to ergonomic problems.

Accordingly, the present invention is directed to an apparatus for feeding signatures to a binding line in such manner as to achieve the foregoing objectives where a pocket is provided adjacent a binding line for receiving signatures to be delivered to the binding line. The apparatus also includes signature feeding means for feeding signatures from a source in a generally vertical direction to a signature receiving and transferring means. The signature receiving and transferring means has a signature receiving end positioned in generally vertically spaced relation to the source and a signature transferring end positioned generally adjacent to the pocket. The signature receiving and transferring means also has means for conveying signatures in a continuous stream from the signature receiving end to the signature transferring end for delivery into the pocket. The apparatus further includes means for inverting the signatures from a first up position to a first down position as the signatures are being conveyed to the pocket including a twist in the conveying means for putting the signatures through a 180° turn. With this arrangement, the inverting means advantageously includes a double belt of the conveying means having a twist for inverting the signatures between the signature receiving end and the signature transferring end of the signature receiving and transferring means.

Preferably, the inverting means also includes a plurality of sets of rollers each of which is disposed at an angle to the next of the sets of rollers for the purpose of inverting the signatures as they are being delivered to the binding line. It is also advantageous for the signature receiving and transferring means to be pivotally mounted to the signature feeding means at the signature receiving end for adjusting the position of the signature transferring end in relation to the location of the pocket to accommodate signatures of varying width. Still further, the apparatus preferably includes first and second feeding means either one of which feeds signatures from the source at any given time to the signature receiving and transferring means with at least one of the feeding means receiving signatures directly from the source.

In a highly preferred embodiment, the signature receiving and transferring means includes a spiral rail extending from the signature receiving end to the signature transferring end of the signature receiving and transferring means for mounting each of the sets of rollers thereon. In this connection, the inverting means preferably includes eight separate sets of rollers each of which is disposed at an angle of 22.5° to the next adjacent of the sets of rollers all of which will be understood to be disposed in spaced relation between the feeding means and the pocket.

Advantageously, the apparatus is adapted to feed first down signatures to a pocket on a patent bound binding line and preferably includes a pocket interface adjacent the binding line. The pocket interface will be understood to deliver signatures to the pocket for delivery in a conventional manner to the binding line after the conveying means has caused signatures to be conveyed in a continuous shingled stream to the pocket interface for delivery into the pocket. With this arrangement, the signature receiving and transferring means is pivotally mounted at the signature receiving end for adjusting the position of the signature transferring end and, thus, the pocket interface relative to the location of the pocket.

In a most highly preferred embodiment, first and second signature feeding means are provided including a lower feeding system and an upper feeding system either one of which feeds signatures from a generally vertical signature stack at any given time to the signature conveying means at the signature receiving end of the signature receiving and transferring means with at least the lower feeding system being generally vertically moveable from a feeding position to a position for receiving signatures directly from the source. Still additionally, the lower feeding system also advantageously comprises a portion of a signature receiving system adapted to control its absolute position when the lower feeding system is in the signature receiving position including a signature supporting plate operatively associated with a drive system which is adapted to move the signature supporting plate from a vertical upper limit in the feeding position to a vertical lower limit in the signature receiving position. In this connection, the signature receiving system preferably includes sensing means operatively associated with the drive system for the signature supporting plate adjustably positioned at a preselected signature loading height for an operator intermediate the vertical upper limit and the vertical lower limit to cause the drive system to initially position the signature supporting plate at the preselected signature loading height to assist the operator in placing signatures thereon.

Preferably, the sensing means causes the drive system to lower the signature supporting plate in such manner as to cause the top of the signatures placed thereon by the operator to be maintained at the preselected signature loading height until the signature supporting plate reaches the vertical lower limit.

As for the upper feeding system, it includes signature supporting fingers operatively associated with a drive system for generally vertical movement of the signature supporting fingers. More specifically, the drive system is adapted to move the signature supporting fingers from a vertical lower limit to a vertical upper limit where the fingers are in the feeding position.

Preferably, the signature receiving end of the signature receiving and transferring means includes shingling means adjacent the top of the generally vertical signature stack for forming signatures into a shingled stream for transfer to the pocket interface by the twisted double belt of the conveying means. In other words, the conveying means defined by the twisted double belt comprises a shingled stream conveyor leading from the shingling means to the signature transferring end positioned adjacent the pocket interface for transferring signatures in the aforementioned shingled stream.

Still further, the apparatus preferably includes feeding system sensing means operatively associated with the drive system for the lower feeding system and a drive system for the upper feeding system including a first sensor at the vertical upper limit and a second sensor at a position intermediate the vertical upper limit and the vertical lower limit. The lower feeding system thus feeds signatures until the signature supporting plate moves vertically above the second sensor at which time the upper feeding system begins feeding signatures as the signature supporting plate moves to the signature receiving position. The upper feeding system then feeds signatures until such time as the signature supporting fingers move vertically above the first sensor at which time the lower feeding system will move to the feeding position so that the signature supporting plate can take over feeding signatures from the signature supporting fingers of the upper feeding system.

In a most highly preferred embodiment, the feeding system sensing means includes pressure sensitive sensing means operatively associated with the signature support fingers which are carried by a retracting mechanism which is responsive to a signal received from the pressure sensitive sensing means. Still additionally, the feeding system sensing means includes a third sensor at the vertical lower limit at a predetermined distance below the second sensor operatively associated with the drive system of the lower feeding system and the signature supporting fingers to accommodate transfer of signature feeding.

Other objects, advantages and features of the present invention will become apparent from a consideration of the following specification taken in conjunction with the accompanying drawings.

DETAILED DESCRIPTION OF THE PREFERRED EMBODIMENT

Figure 1:
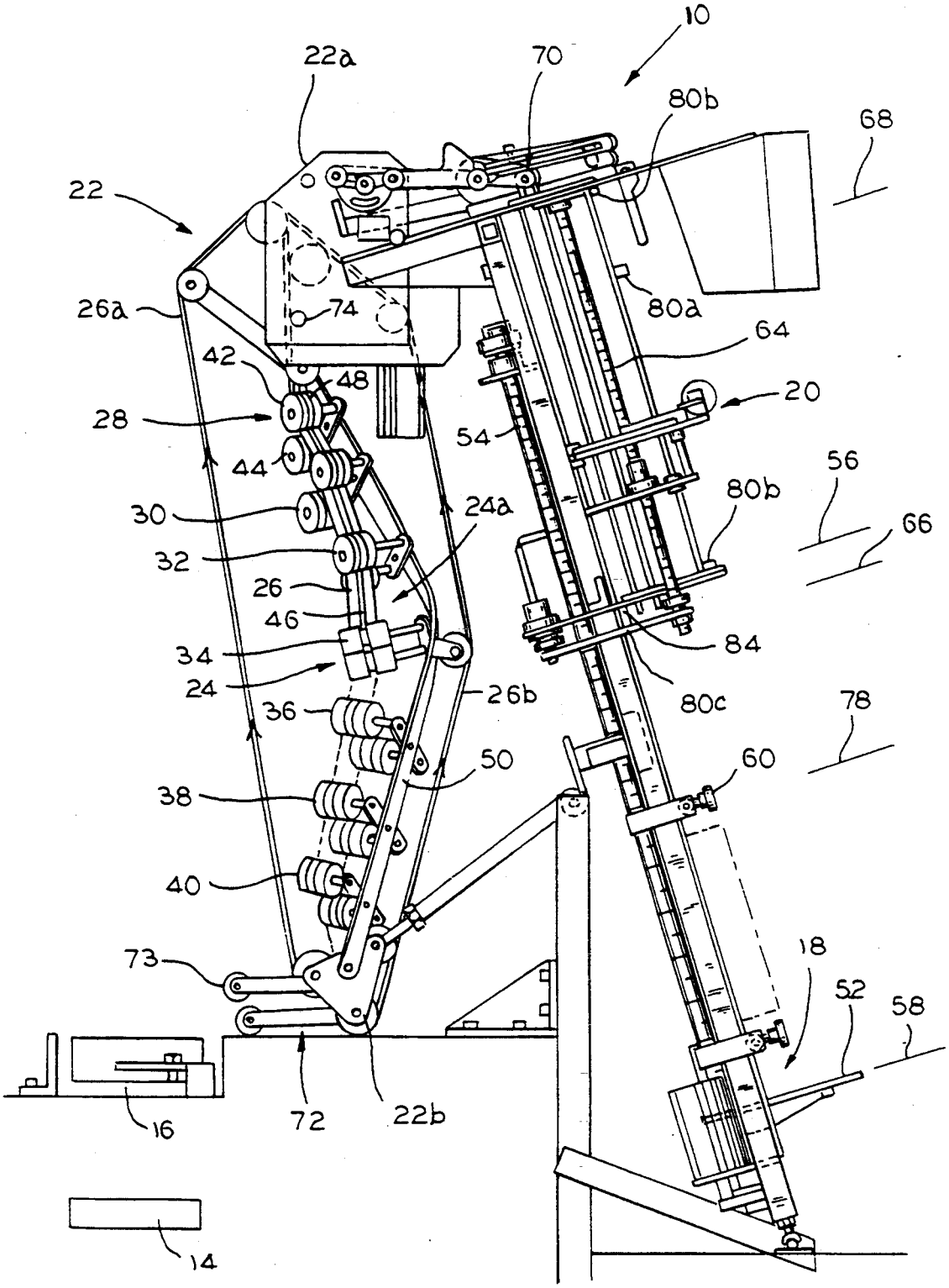
FIG. 1 is a side elevational view of a signature feeding apparatus in accordance with the present invention.

In the illustrations given, and with reference first to FIG. 1, the reference numeral 10 designates generally an apparatus for feeding signatures 12 to a binding line 14. The signature feeding apparatus 10 includes a pocket 16 adjacent the binding line 14 for receiving signatures 12 to be delivered to the binding line 14. It will also be appreciated by referring to FIG. 2 that the apparatus 10 includes signature feeding means and, preferably, first and second signature feeding means 18 and 20 for feeding signatures 12 from a source (not shown) in a generally vertical direction to a signature receiving and transferring means 22. In this connection, the signature feeding apparatus 10 further contemplates at least one of the feeding means 18 being adapted to receive signatures 12 directly from the source (see, also, FIG. 2).

As previously mentioned, and as will be appreciated from FIG. 1, the first and second feeding means 18 and 20 are adapted to feed signatures 12 to the signature receiving and transferring means 22 in a generally vertical but slightly inclined stack.

Referring to FIG. 1, the signature receiving and transferring means 22 will be understood as having a signature receiving end **22*a* which is positioned in generally vertically spaced relation to the source and a signature transferring end 22*b* which is positioned generally adjacent to the pocket 16. More specifically, the signature receiving end 22*a* will be seen to be positioned generally above the first and second feeding means 18 and 20 in the illustrated and preferred embodiment. In this connection, the signature receiving and transferring means will also be understood as having means for conveying signatures, generally designated 24, in a continuous stream from the signature receiving end 22*a* to the signature transferring end 22*b* for delivery into the pocket 16**.

Still referring to FIG. 1, the apparatus 10 includes means for inverting the signatures 12 from a first up position to a first down position as the signatures 12 are being conveyed to the pocket 16. The inverting means advantageously includes a twist in the conveying means as at 24a for putting the signatures 12 through a 180° turn between the signature receiving end 22a and the signature transferring end 22b of the signature receiving and transferring means 22. Specifically, the inverting means may advantageously include a double belt 26 comprised of belts 26a and 26b having a twist for inverting the signatures 12 as previously described.

In addition, the inverting means preferably includes a plurality of sets of rollers 28, 30, 32, 34, 36, 38, and 40 each comprised of a pair of closely spaced rollers such as 42 and 44. It will be seen and appreciated that each of the sets of rollers are mounted at an angle to the next adjacent of the sets of rollers for inverting the signatures 12. Still additionally, the belts 26a and 26b each preferably include a tongue such as 46 which rides within a central circumferentially extending groove such as 48 in the rollers such as 42 substantially as shown.

With this arrangement, the tongues such as 46 disposed within the circumferential grooves such as 48 in the rollers such as 42 cause the belts 26a and 26b to be guided or track along the path of movement which causes the signatures 12 to be inverted. In other words, the belts 26a and 26b are substantially confined for movement such that the double belt 26 has a twist as at 24a causing the signatures to be put through a 180° turn between the signature receiving end 22a and the signature transferring end 22b of the signature receiving and transferring means 22. With this guided movement caused by the tracking of the belts 26a and 26b, the signatures 12 are efficiently and effectively inverted from a first up position to a first down position as they are conveyed to the pocket 16 for utilization on a patent bound line 14.

As also shown, the signature receiving and transferring means 22 includes a spiral rail 50 extending from the signature receiving end 22a to the signature transferring end 22b of the signature receiving and transferring means 22. This spiral rail 50 serves to accommodate mounting the respective sets of rollers 28, 30, 32, 34, 36, 38, and 40 thereon. More specifically, the eight sets of rollers may be mounted on the spiral rail 50 so as to be disposed at an angle of22.5° to the next adjacent of the sets of rollers in spaced relation to one another between the feeding means 18 and/or 20 and the pocket 16.

In the illustrated embodiment, the apparatus 10 includes first and second feeding means 18 and 20 either one of which feeds signatures 12 from the source at any given time to the signature receiving and transferring means 22. The first and second signature feeding means advantageously comprise a lower feeding system 18 and an upper feeding system 20 either one of which feeds signatures from a generally vertical signature stack at any given time to the signature conveying means 24 at the signature receiving end 22a of the signature receiving and transferring means 22 with at least the lower feeding system 18 being generally vertically moveable from a feeding position to a position for receiving signatures directly from the source. Preferably, the lower feeding system 18 also comprises a portion of a signature receiving system adapted to control the absolute position of the lower feeding system when it is in the signature receiving position substantially as shown in FIG. 1.

Figure 3:
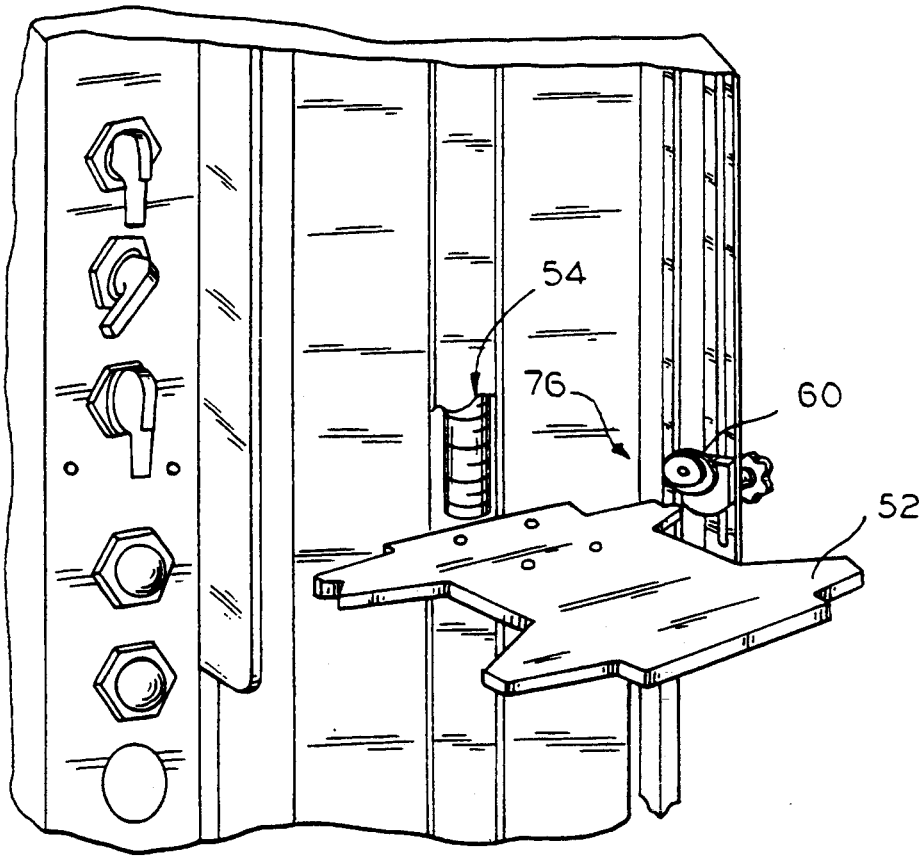
FIG. 3 is a detailed view of a portion of a lower feeding system including a signature supporting plate.

Referring to FIGS. 1 and 3, the lower feeding system 18 advantageously includes a signature supporting plate 52 operatively associated with a drive system 54 for the plate 52 which is adapted to move the signature supporting plate 52 from a vertical upper limit 56 to a vertical lower limit 58 in the signature receiving position. The signature receiving system includes sensing means 60 operatively associated with the drive system 54 for the signature supporting plate 52 adjustably positioned at a preselected signature loading height for an operator intermediate the vertical upper limit 56 and the vertical lower limit 58 to cause the drive system 54 to initially position the signature supporting plate 52 at the preselected signature loading height to assist the operator in placing signatures thereon. As will be appreciated, the sensing means 60 causes the drive system 54 to lower the signature supporting plate 52 in such manner as to cause the top of the signatures 12 placed thereon by the operator to be maintained at the preselected signature loading height until the signature supporting plate 52 reaches the vertical lower limit 58.

Figure 4:
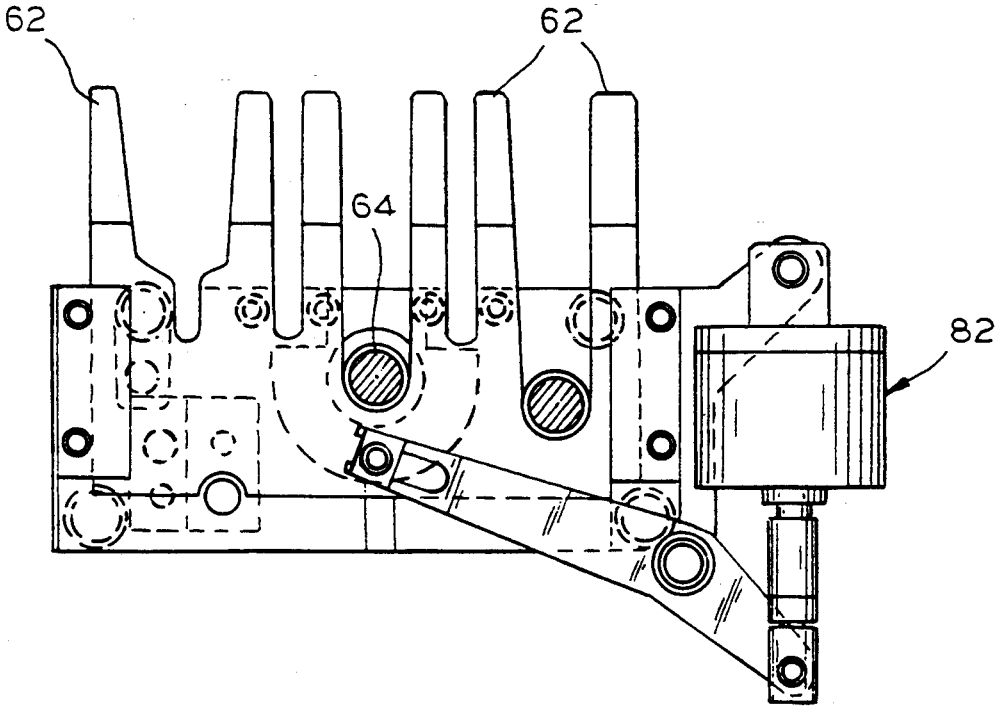
FIG. 4 is a detailed plan view of one side of an upper feeding system having signature supporting fingers.
Figure 5:
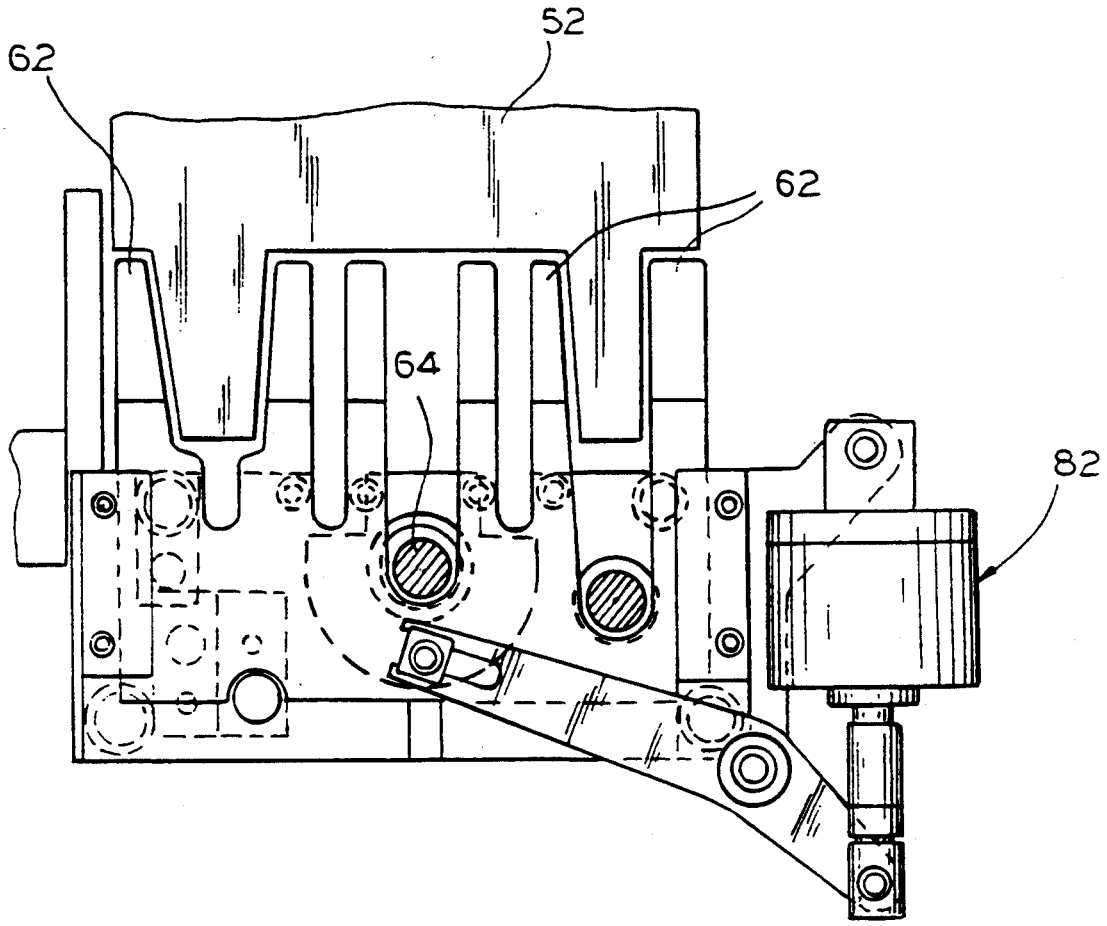
FIG. 5 is a plan view of the signature supporting plate and the signature supporting fingers.

Referring now to FIG. 4, the upper feeding system 20 includes signature supporting fingers 62 which are operatively associated with a drive system 64 for the fingers 62. As will be appreciated, the drive system 64 is adapted to move the signature supporting fingers 62 from a vertical lower limit 66 to a vertical upper limit 68 in the feeding position.

Referring to FIG. 1, the signature receiving end 22a of the signature receiving and transferring means 22 includes shingling means 70 adjacent the top of the generally vertical signature stack for forming signatures 12 into a shingled stream for transfer to the pocket 16. Preferably, the transfer to the pocket 16 takes place through a pocket interface generally designated 72 which directs the signatures 12 travelling in a head first direction, i.e., parallel to the backbone, into the pocket 16 by utilizing arm supported rollers 73 or other conventional components. In this connection, the signature receiving and transferring means 22 is advantageously pivotally mounted as at 74 to the structure supporting the signature feeding means 18 and 20 at the signature receiving end 22a for adjusting the position of the signature transferring end 22b and, thus, the pocket interface 72 in relation to the location of the pocket 16.

Referring to FIG. 3, the signature receiving system generally designated 76 includes what may be called the receiving system sensing means 60 which is operatively associated with the drive system 54 for the signature supporting plate 52 in such manner as to be adjustably positioned at the preselected signature loading height 78 for an operator intermediate the vertical upper limit 56 and the vertical lower limit 58. As will be appreciated, the receiving system sensing means 60 causes the drive system 54 to initially position the signature supporting plate 52 at the preselected signature loading height 78 for the purpose of assisting the operator in placing signatures 12 thereon when the signature supporting plate 52 is in the signature receiving position for receiving signatures from the source.

Figure 2:
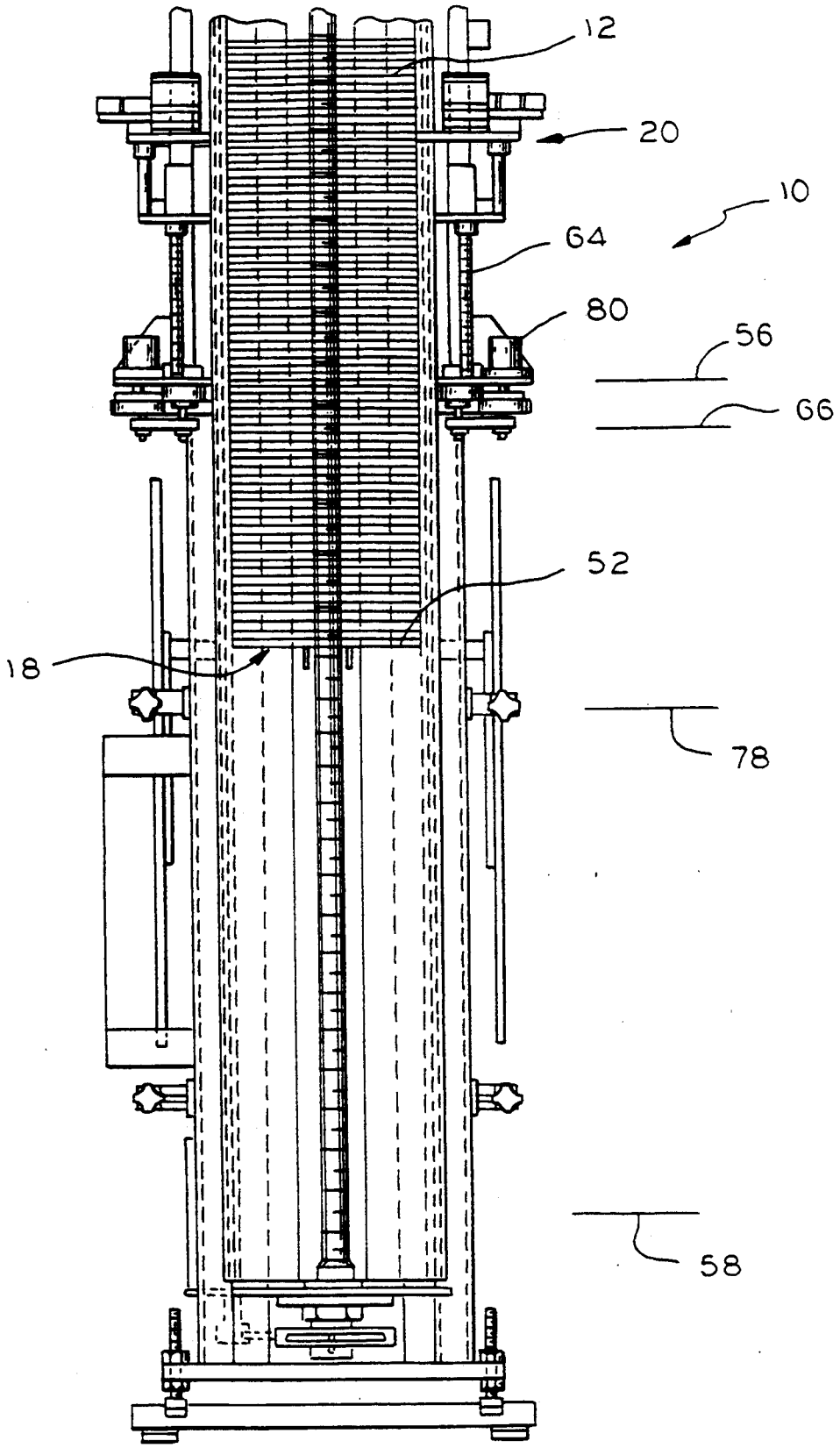
FIG. 2 is a rear elevational view of the signature feeding apparatus illustrated in FIG. 1.

Referring to FIG. 2, the signature feeding apparatus 10 also includes feeding system sensing means 80 operatively associated with both of the drive systems 54 and 64 of the lower and upper feeding systems 18 and 20, respectively. The feeding system sensing means 80 includes a first sensor 80a at the vertical upper limit 68 and a second sensor 80b at a position intermediate the vertical lower limit 66 and the vertical upper limit 68. The lower feeding system 18 feeds signatures 12 until the signature supporting plate 52 moves vertically above the second sensor 80b. The upper feeding system 20 then feeds signatures 12 while the signature supporting plate 52 moves to the signature receiving position 78 to receive further signatures 12 directly from the source. The upper feeding system 20 feeds signatures 12 until the signature supporting fingers 62 move vertically above the first sensor 80*a*. As will be appreciated, the lower feeding system 18 will then move to the feeding position so the signature supporting plate 52 can take over feeding signatures 12 from the signature supporting fingers 62 of the upper feeding system 20.

In addition, the feeding system sensing means 80 may include pressure sensitive means associated with the signature supporting fingers 62 which are carded by a retracting mechanism 82 responsive to a signal from the pressure sensitive sensing means. The feeding system sensing means 80 may alternatively include a third sensor 80*c* at the vertical lower limit 66 at a predetermined distance below the second sensor 80*b*. With this arrangement, the third sensor 80*c* may then be operatively associated with the drive system 54 of the lower feeding system 18 as well as the signature supporting fingers 62 to accommodate transfer of the signature feeding function.

As for the drive systems 54 and 64, they are preferably of the screwdrive type. The signature supporting fingers 62 are carded by the retracting mechanism 82 and the third sensor 80*c* is operatively associated with a counter 84 activated when the third sensor 80*c* senses signatures 12. With these features, the counter 84 is operatively associated with the retracting mechanism 82.

More specifically, the counter 84 associates revolutions of the screwdrive system 54 for the lower feeding system 18 with distance traveled. As a result, the counter 84 can activate the retracting mechanism 82 to retract the signature supporting fingers 62 when the lower feeding mechanism 18 has traveled a predetermined distance. Specifically, the predetermined distance will be that which is sufficient to position the top of the signatures 12 carried by the lower feeding system 18 adjacent the fingers 62.

In addition to the foregoing, the feeding system sensing means 80 may also include an automatic operation shut-off sensor 80*d* positioned above the first sensor 80*a* for terminating operation of the signature feeding apparatus 10 if the signature supporting fingers 62 should reach the automatic shut-off sensor 80*d*.

As for other details of the invention, they may advantageously take the form of either conventional binding line components or the corresponding structure which has been disclosed in commonly owned U.S. Pat. No. 5,114,129 of Chang et al. issued May 19, 1992 for: "Signature Feeding Apparatus", the disclosure of which is incorporated herein fully and completely by reference for that purpose.

While in the foregoing there has been set forth a preferred embodiment of the invention, it will be appreciated that the details herein given may be varied by those skilled in the art without departing from the true spirit and scope of the appended claims.

I claim:

1. An apparatus for feeding signatures to a binding line, comprising:

a pocket adjacent a binding line for receiving signatures to be delivered to said binding line;

signature feeding means for feeding signatures in a generally vertical direction to a signature receiving and transferring means;

said signature receiving and transferring means having a signature receiving end positioned generally above said signature feeding means and a signature transferring end positioned generally adjacent to said pocket;

said signature receiving and transferring means having means for conveying signatures in a continuous stream from said signature receiving end to said signature transferring end for delivery into said pocket; and means for inverting said signatures from a first up position to a first down position as said signatures are being conveyed to said pocket, said conveying means comprising a double belt and said inverting means including a plurality of sets of rollers where each set of rollers is at an angle to a next adjacent set of rollers for inverting said signatures between said signature receiving end and said signature transferring end of said signature receiving and transferring means, said sets of rollers each being comprised of a pair of closely spaced rollers and said inverting means further including a twist in said double belt for putting said signatures through a turn between said signature receiving end and said signature transferring end of said signature receiving and transferring means, said double belt being substantially confined between said closely spaced rollers of each of said sets of rollers for guided movement along a path to cause said signatures to be inverted.

2. The signature feeding apparatus of claim 1 wherein said signature receiving and transferring means is pivotally mounted to said signature feeding means at said signature receiving end for adjusting the position of said signature transferring end in relation to said pocket.

3. The signature feeding apparatus of claim 1 including first and second feeding means for continuously feeding signatures from one or the other of said feeding means to said signature receiving and transferring means with at least one of said feeding means receiving signatures directly from a supply thereof.

4. An apparatus for feeding signatures to a binding line, comprising;

a pocket adjacent a binding line for receiving signatures to be delivered to said binding line;

signature feeding means for feeding signatures in a generally vertical direction to a signature receiving and transferring means;

said signature receiving and transferring means having a signature receiving end positioned generally above said signature feeding means and a signature transferring end positioned generally adjacent to said pocket;

said signature receiving and transferring means having means for conveying signatures in a continuous shingled stream from said signature receiving end to said signature transferring end for delivery into said pocket; and means for inverting said signatures from a first up position to a first down position as said signatures are being conveyed to said pocket, said conveying means comprising a double belt and said inverting means including a plurality of sets of rollers where each set of rollers is at an angle to a next adjacent set of rollers for inverting said signatures between said signature receiving end and said signature transferring end of said signature receiving and transferring means, said sets of rollers each being comprised of a pair of closely spaced rollers and said inverting means also including a twist in said double belt for putting said signatures through a 180° turn between said signature receiving end and said signature transferring end of said signature receiving and transferring means, said double belt being substantially confined between said closely spaced rollers of each of said sets of rollers for guided movement along a path thereby causing said signatures to be inverted as said signatures are being conveyed from said feeding means for delivery to said pocket.

5. The signature feeding apparatus of claim 4 wherein said signature receiving and transferring means is pivotally mounted to said signature feeding means at said signature receiving end for adjusting the position of said signature transferring end in relation to the location of said pocket.

6. The signature feeding apparatus of claim 4 including first and second feeding means for continuously feeding signatures from one or the other of said feeding means to said signature receiving and transferring means with at least one of said feeding means receiving signatures directly from a supply thereof.

7. The signature feeding apparatus of claim 4 wherein said signature receiving and transferring means includes a spiral rail extending from said signature receiving end to said signature transferring end of said signature receiving and transferring means for mounting said sets of roller thereon.

8. The signature feeding apparatus of claim 4 wherein said plurality of sets of rollers includes eight sets of rollers each of which is disposed at an angle of 22.5° to a next adjacent of said sets of rollers all of which are disposed in spaced relation between said feeding means and said pocket.

9. An apparatus for feeding first down signatures to a pocket on a patent bound binding line, comprising;

a pocket interface adjacent said binding line for delivering signatures to said pocket for delivery to said binding line;

signature feeding means for feeding signatures in a generally vertically upward direction to a signature receiving and transferring means;

said signature receiving and transferring means having a signature receiving end positioned generally above said signature feeding means and a signature transferring end positioned generally adjacent to said pocket interface;

said signature receiving and transferring means being pivotally mounted to said signature feeding means at said signature receiving end for adjusting the position of said signature transferring end and said pocket interface in relation to the location of said pocket;

said signature receiving and transferring means having means for conveying signatures in a continuous shingled stream from said signature receiving end to said signature transferring end and said pocket interface for delivery into said pocket; and means for inverting said signatures from a first up position to a first down position as said signatures are being conveyed to said pocket interface, said inverting means including a twist in said conveying means defined by a twisted double belt for putting said signatures through a 180° turn, said inverting means also including a plurality of sets of rollers each at an angle to a next for engagement by said double belt, said belts and rollers causing said signatures to be inverted as said signatures are being conveyed from said feeding means for delivery into said pocket;

said signature receiving and transferring means including a spiral rail extending from said signature receiving end to said signature transferring end of said signature receiving and transferring means for rotatably mounting said sets of rollers thereon, said plurality of sets of rollers including eight sets of rollers of each of which is disposed at an angle of 22.5° to a next adjacent of said sets of rollers all of which are disposed in spaced relation between said feeding means and said pocket interface.

10. The signature feeding apparatus of claim 9 including first and second signature feeding means comprising a lower feeding system and an upper feeding system for continuously feeding signatures from one or the other of said lower and upper feeding systems in a generally vertical signature stack to said signature conveying means at said signature receiving end of said signature receiving and transferring means with at least said lower feeding system being generally vertically movable from a feeding position to a position for receiving signatures directly from a supply thereof.

11. The signature feeding apparatus of claim 10 wherein said lower feeding system also comprises a portion of a signature receiving system adapted to control an absolute position of said lower feeding system when said lower feeding system is in said signature receiving position including a signature supporting plate operatively associated with a drive system for said plate which is adapted to move said signature supporting plate from a vertical upper limit in said feeding position to a vertical lower limit in said signature receiving position.

12. The signature feeding apparatus of claim 11 wherein said signature receiving system includes sensing means operatively associated with said drive system for said signature supporting plate adjustably positioned at a preselected signature loading height for an operator intermediate said vertical upper limit and said vertical lower limit to cause said drive system to initially position said signature supporting plate at said preselected signature loading height to assist said operator in placing signatures thereon.

13. The signature feeding apparatus of claim 12 wherein said sensing means causes said drive system to lower said signature supporting plate in such manner as to cause a top one of said signatures placed thereon by said operator to be maintained at said preselected signature loading height until said signature supporting plate reaches said vertical lower limit.

14. The signature feeding apparatus of claim 10 wherein said upper feeding system includes signature supporting fingers operatively associated with a drive system for said fingers which is adapted to move said signature supporting fingers from a vertical lower limit to a vertical upper limit where said fingers are in said feeding position.

15. The signature feeding apparatus of claim 10 wherein said signature receiving end of said signature receiving and transferring means includes shingling means adjacent a top of said generally vertical signature stack for forming signatures into a shingled stream for transfer to said pocket interface by said twisted double belt of said conveying means.

16. An apparatus for feeding signatures to a binding line, comprising:

a pocket adjacent a binding line for receiving signatures to be delivered to said binding line;

signature feeding means for feeding signatures in a generally vertical direction to a signature receiving and transferring means;

said signature receiving and transferring means having a signature receiving end positioned generally above said signature feeding means and a signature transferring end positioned generally adjacent to said pocket;

said signature receiving and transferring means having means for conveying signatures in a continuous stream from said signature receiving end to said signature transferring end for delivery into said pocket; and means for inverting said signatures from a first up position to a first down position as said signatures are being conveyed to said pocket, said conveying means comprising a double belt and said inverting means including a plurality of sets of rollers where each set of rollers is at an angle to a next adjacent set of rollers for inverting said signatures between said signature receiving end and said signature transferring end of said signature receiving and transferring means, said sets of rollers each being comprised of a pair of closely spaced rollers and said inverting means further including a twist in said double belt for putting said signatures through a turn between said signature receiving end and said signature transferring end of said signature receiving and transferring means, said double belt being substantially confined between said closely spaced rollers of each of said sets of rollers for guided movement along a path to cause said signatures to be inverted;

said signature feeding means comprising a lower feeding system and an upper feeding system either one of which feeds signatures from a generally vertical signature stack at any given time to said signature conveying means at said signature receiving end of said signature receiving and transferring means with at least said lower feeding system being generally vertically movable from a feeding position to a position for receiving signatures directly from said source;

said lower feeding system also comprising a portion of a signature receiving system adapted to control an absolute position of said lower feeding system when said lower feeding system is in said signature receiving position including a signature supporting plate operatively associated with a drive system for said plate which is adapted to move said signature supporting plate from a vertical upper limit in said feeding position to a vertical lower limit in said signature receiving position;

said signature receiving system including receiving system sensing means operatively associated with said drive system for said signature supporting plate adjustably positioned at a preselected signature loading height for an operator intermediate said vertical upper limit and said vertical lower limit to cause said drive system to initially position said signature supporting plate at said preselected signature loading height to assist said operator in placing signatures thereon.

17. The signature feeding apparatus of claim 16 wherein said signature receiving and transferring means is pivotally mounted to said signature feeding means at said signature receiving end for adjusting the position of said signature transferring end in relation to said pocket.

18. The signature feeding apparatus of claim 16 wherein said receiving system sensing means causes said drive system to lower said signature supporting plate in such manner as to cause a top one of said signatures placed thereon by said operator to be maintained at said preselected signature loading height until said signature supporting plate reaches said vertical lower limit.

19. The signature feeding apparatus of claim 18 including feeding system sensing means operatively associated with said drive system for said lower feeding system and a drive system for said upper feeding system including a first sensor at said vertical upper limit and a second sensor at a position intermediate said vertical upper limit and said vertical lower limit.

20. The signature feeding apparatus of claim 19 wherein said lower feeding system feeds signatures until said signature supporting plate moves vertically above said second sensor when said upper feeding system begins feeding signatures as said signature supporting plate moves to said signature receiving position.

21. The signature feeding apparatus of claim 20 wherein said upper feeding system feeds signatures until said signature supporting fingers move vertically above said first sensor when said lower feeding system moves to said feeding position so said signature supporting plate can take over feeding signatures from said signature supporting fingers of said upper feeding system.

22. The signature feeding apparatus of claim 21 wherein said feeding system sensing means includes pressure sensitive sensing means operatively associated with said signature supporting fingers which signature supporting fingers are carried by a retracting mechanism responsive to a signal from said pressure sensitive sensing means.

23. The signature feeding apparatus of claim 22 wherein said feeding system sensing means includes a third sensor at said vertical lower limit at a predetermined distance below said second sensor operatively associated with said drive system of said lower feeding system and said signature supporting fingers to accommodate transfer of signature feeding.

24. The signature feeding apparatus of claim 16 wherein said upper feeding system includes signature supporting fingers operatively associated with a drive system for said fingers which is adapted to move said signature supporting fingers from a vertical lower limit to a vertical upper limit where said fingers are in said feeding position.

25. The signature feeding apparatus of claim 16 wherein said signature receiving end of said signature receiving and transferring means includes shingling means adjacent the top of said generally vertical signature stack for forming signatures into a shingled stream for transfer to said pocket interface by said twisted double belt of said conveying means.

* * * * *